US011346175B2

(12) United States Patent
Reinås et al.

(10) Patent No.: US 11,346,175 B2
(45) Date of Patent: May 31, 2022

(54) CONNECTOR

(71) Applicant: EQUINOR ENERGY AS, Stavanger (NO)

(72) Inventors: Lorents Reinås, Stavanger (NO); Harald Sigurd Nesse, Sandnes (NO); Per Osen, Oslo (NO); Morten Sæther, Lillestrøm (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 16/497,219

(22) PCT Filed: Jan. 30, 2018

(86) PCT No.: PCT/NO2018/050027
§ 371 (c)(1),
(2) Date: Sep. 24, 2019

(87) PCT Pub. No.: WO2018/182423
PCT Pub. Date: Oct. 4, 2018

(65) Prior Publication Data

US 2020/0018133 A1 Jan. 16, 2020

(30) Foreign Application Priority Data

Mar. 28, 2017 (GB) ..... 1704944

(51) Int. Cl.
*E21B 33/038* (2006.01)

(52) U.S. Cl.
CPC ..... *E21B 33/038* (2013.01)

(58) Field of Classification Search
CPC ..... E21B 33/038
(Continued)

(56) References Cited

U.S. PATENT DOCUMENTS 3,523,578 A 8/1970 Nolan, Jr. et al.
3,709,182 A * 1/1973 Horton ..... B63B 21/50 114/294
(Continued)

FOREIGN PATENT DOCUMENTS

CA 1074225 3/1980
WO 2011/162616 12/2011
(Continued)

OTHER PUBLICATIONS

International Search Report dated Mar. 28, 2018 in International (PCT) Application No. PCT/NO2018/050027.
(Continued)

*Primary Examiner* — Matthew R Buck
*Assistant Examiner* — Patrick F Lambe
(74) *Attorney, Agent, or Firm* — Wenderoth, Lind & Ponack, L.L.P.

(57) ABSTRACT

A connector for connecting two subsea well assembly components; wherein the connector is arranged such that it can be preloaded in both tension and compression concurrently. The connector includes a tension part which in use can be in tension and a compression part that in use can be in compression. The tension part has an adjustable length and/or the compression part has an adjustable length. There is also provided a subsea well assembly, that includes a first subsea well assembly component; and a second subsea well assembly component; wherein the first subsea well assembly component and the second subsea well assembly component are connected to each other to provide a well conduit therebetween. The first subsea well assembly component and the second subsea well assembly component are connected such that forces can be transmitted both in tension and compression between the two components without going through the well conduit.

20 Claims, 3 Drawing Sheets

(58) Field of Classification Search
USPC ..... 166/360
See application file for complete search history.

(56) References Cited

U.S. PATENT DOCUMENTS

| | | | | |
|---|---|---|---|---|
| 3,953,982 | A | 5/1976 | Pennock | |
| 5,839,524 | A * | 11/1998 | Sanford | E21B 17/046 175/320 |
| 6,062,312 | A | 5/2000 | Wilkins | |
| 6,138,762 | A | 10/2000 | Sweeney et al. | |
| 9,618,069 | B2 * | 4/2017 | DeStories | B25B 5/12 |
| 2012/0006555 | A1 | 1/2012 | Fraser et al. | |
| 2014/0363225 | A1 | 12/2014 | Shield et al. | |
| 2018/0003008 | A1 * | 1/2018 | Osen | E21B 33/035 |
| 2018/0073664 | A1 * | 3/2018 | Readman | E21B 43/013 |

FOREIGN PATENT DOCUMENTS

| | | |
|---|---|---|
| WO | 2016/038396 | 3/2016 |
| WO | 2016/118019 | 7/2016 |
| WO | 2017/155415 | 9/2017 |

OTHER PUBLICATIONS

UK—IPO Search Report dated Aug. 9, 2017 in GB Application No. 1704944.6.

Written Opinion of the International Searching Authority dated Mar. 28, 2018 in International (PCT) Application No. PCT/NO2018/050027.

Examination Report under Section 18(3) dated Mar. 1, 2022 in corresponding GB Application No. 1704944.6.

* cited by examiner

CONNECTOR

The invention relates to a connector for connecting two subsea well assembly components, a subsea well assembly in which a first and second subsea well assembly component are connected to provide a well fluid conduit therethrough and additionally connected such that at least some forces can be transmitted between the components without going (i.e. without going entirely) through the well fluid conduit and a method of installing a subsea wellhead assembly which comprises connecting first and second subsea well assembly component to provide a well fluid conduit therethrough and additionally connecting the first and second subsea well assembly components such that at least some forces can be transmitted between the first and second subsea well assembly components without going (i.e. without going entirely) through the well fluid conduit.

A typical subsea assembly comprises a subsea wellhead (i.e. high pressure wellhead housing) to which subsea well valves (e.g. well control devices), such as a blowout preventer (which may comprise a lower stack and a lower marine riser package (LMRP)) and/or a Christmas tree (which may also be referred to as a subsea tree) may be connected. The subsea well valves (e.g. well control devices) are connected (in a downwards direction) to the wellhead and are typically connected (in an upwards direction) to a riser that extends between this wellhead valve and a surface facility, such as a floating vessel. The riser typically provides a conduit for the drill string and drilling fluids between the subsea well and the surface facility. The assembly provides a well fluid conduit from the seabed to the surface facility.

It is important that the wellhead assembly integrity is maintained so that structural failure and uncontrolled release of well fluids from the well conduit does not occur. As a result, it is desirable that forces that act on the assembly have as low risk as possible of damaging the assembly and in particular the well conduit.

US 2014/0374115 discloses a system for tethering a subsea blowout preventer to the sea bed via a plurality of anchors which are disposed about the subsea BOP and secured to the sea floor. This system can reduce the riser load effects in subsea blowout preventers below the tethering point, wellheads and primary conductors and thereby reduce the risk of damage. However this system requires the installation of anchors in the sea floor and may be relatively expensive and time consuming to install.

WO 2011/162616 discloses a stabilization device for a wellhead wherein a wellhead valve is supported on a suction substructure by multiple supporting elements.

There is a desire for alternative and/or improved means to provide well conduit load relief.

In a first aspect the present invention provides a connector (e.g. load transmitting connector) for connecting two subsea well assembly components; wherein the connector is arranged such that it can be preloaded in both tension and compression concurrently.

The connector may comprise a tension part which is arranged such that it may be preloaded in tension and a compression part which is arranged such that it may be preloaded in compression. The tension part may have an adjustable length and/or the compression part may have an adjustable length. Thus, in another aspect the present invention may provide a connector for connecting two subsea well assembly components; wherein the connector is arranged such that it can be preloaded in both tension and compression concurrently, wherein the connector comprises a tension part which in use can be in tension and a compression part that in use can be in compression, and wherein the tension part has an adjustable length and/or the compression part has an adjustable length.

By connector that may be preloaded in both tension and compression may allow the connection formed by the connector to be more rigid and more suitable for load transfer.

By having an adjustable length may mean that the connector is easier to install and the preload can be controlled.

The two subsea well assembly components may be two wellhead valves (such as a BOP, Christmas tree or capping stack for example), or it may be a wellhead valve and a subsea foundation (such as a suction anchor or template) for example.

For example the connector may be a connector for connecting a wellhead valve to a subsea well foundation; wherein the connector can be preloaded in both tension and compression concurrently.

In other words the connector is arranged such that when in use (i.e. when connected between two subsea well assembly components, such as equipment mounted on a wellhead and a well foundation) it can be preloaded in both tension and compression simultaneously (i.e. at least part of the connector is preloaded in tension (i.e. a tension part) and at least part of the connector is preloaded in compression (i.e. a compression part)).

The connector may also be referred to as a connection member, linking member, structural element for example. The connector may for example comprise two connection points (i.e. one at each end) and a linking element (e.g. structural beam) therebetween. The linking element may have an adjustable length. The linking element may comprise at least one part that can be adjusted in length independently of the other parts of the linking element.

The connector may be an element or member that is for connecting two subsea well assembly components such as for connecting a well valve or subsea riser system equipment to a well foundation. The connector may allow at least part of the forces transferred between the two components to be transferred by the connector, rather than by another connector means such as that which forms the well conduit. The connector may be referred to as a load transmitting connector.

In a second aspect the present invention provides a subsea well assembly, the assembly comprising: a first subsea well assembly component; and a second subsea well assembly component; wherein the first subsea well assembly component and the second subsea well assembly component are connected to each other (such as by a fluid sealing connector) to provide a well conduit therebetween; and wherein the first subsea well assembly component and the second subsea well assembly component are additionally connected (e.g. by one or more load transmitting connectors) such that at least some forces can be transmitted both in tension and compression between the two components without going through the well conduit.

At least one of the one or more load transmitting connectors may be arranged so that it can be preloaded in tension and at least one of the one or more load transmitting connectors may be arranged so that it can be preloaded in compression.

Thus in another aspect the present invention may provide a subsea well assembly, the assembly comprising: a first subsea well assembly component; and a second subsea well assembly component; wherein the first subsea well assembly component and the second subsea well assembly component are connected to each other to provide a well conduit therebetween; and wherein the first subsea well assembly component and the second subsea well assembly component are additionally connected by one or more load transmitting connectors such that at least some forces can be transmitted both in tension and compression between the two components without going through the well conduit, wherein at least one of the one or more load transmitting connectors is arranged so that it can be preloaded in tension and at least one of the one or more load transmitting connectors is arranged so that it can be preloaded in compression.

The assembly may comprise a well conduit, e.g. a well fluid conduit for well fluids and/or drilling equipment, that extends through both the first subsea well assembly component and the second subsea well assembly component and is formed in part by the fluid sealing connector (i.e. well conduit connector).

For example, in the case that one of the components comprises a BOP, the well conduit may be provided at least in part by the drill through conduit in the BOP, i.e. the central bore through which drilling can occur. In the case that one of the components comprises a well foundation, the well conduit may be provided at least in part by the wellhead supported in the well foundation. The well conduit may also be provided at least in part by connectors between components. These may be fluid connectors and/or guiding connectors to link the conduit/bore in one component to the conduit/bore in another component.

The first subsea well assembly component and the second subsea well assembly component may be connected to each other to provide a continuous sealed well fluid flow conduit through the two components and hence through the assembly.

The two components being connected such that at least some forces can be transmitted between the two components without going through the well conduit (e.g. well fluid conduit, drill through conduit etc.), means that forces are transmitted through the additional connection (e.g. by means of one or more force transmitting connectors) between the components rather than only through the components that provide the well conduit (such as the well conduit connector that may for example be a fluid sealing connector).

The two components may be connected only by the well conduit and well conduit connectors and the one or more force transmitting connectors. There may be an axial gap between the bottom surface of one component and the top surface of the other component.

The first subsea well assembly component may be a wellhead valve and/or a well control device (such as a BOP, Christmas tree or capping stack for example) or a well foundation (such as a suction anchor or template for example). The second subsea well assembly component may be a wellhead valve and/or a well control device (such as a BOP, Christmas tree or capping stack for example) or a well foundation (such as a suction anchor or template for example).

The well foundation may laterally support the wellhead. This may be at a single lateral point (i.e. so that lateral forces can be resisted) or at a plurality of points (i.e. so it is more capable of resisting bending moments).

One of the subsea well assembly components may also be dedicated for well workover operations. For example, one of the components may be a Lower Workover Riser Package (LWRP) run on its dedicated Work Over Riser or a Subsea landing string installed inside a conventional subsea BOP whilst it is latched to the top of another well valve and/or well control device such as a Christmas tree. The use of one or more force transmitting connectors between the components may allow such an arrangement of components whilst ensuring that the loads exerted on the well conduit are within acceptable limits.

When one of the components is a Christmas tree it may be a vertical type or a horizontal type tree.

The well conduit may in part be provided by a subsea wellhead and/or one or more well conduit connector, e.g. a fluid sealing connectors, between the subsea well assembly components.

Thus, for example, the invention may provide a subsea wellhead assembly, the assembly comprising: a subsea well foundation; a subsea wellhead; and subsea well valve and/or well control device mounted on the subsea wellhead; wherein the subsea well valve and/or well control device is connected to the subsea well foundation such that forces can be transmitted both in tension and compression between the subsea well valve and/or well control device and the subsea well foundation (e.g. such that at least part of the forces do not go through the wellhead).

The subsea well assembly components (such as well valve or subsea riser system equipment and subsea well foundation) may be connected by one or more connectors, i.e. force transmitting connectors. One or more of these connectors may be a connector according to the first aspect of the invention.

In a third aspect the present invention provides a method of installing a subsea well assembly, the method comprising: providing a first subsea well assembly component and a second subsea well assembly component; connecting (such as by means of a well conduit connector, e.g. fluid sealing connector) the first subsea well assembly component and the second subsea well assembly component such that there is a well conduit (e.g. for well fluids) that extends (e.g. sealingly) through both the first subsea well assembly component and the second subsea well assembly component; and additionally connecting (e.g. by one or more load transmitting connectors) the first subsea well assembly component and the second subsea well assembly component such that forces can be transmitted both in tension and compression between the first and second subsea well assembly components. This may allow forces to be transferred partly or completely without going via the well fluid conduit (i.e. the components that form the well fluid conduit such as internal piping of the components, fluid sealing connectors and wellhead).

At least one of the one or more load transmitting connectors may be arranged so that it can be preloaded in tension and at least one of the one or more load transmitting connectors may be arranged so that it can be preloaded in compression.

Thus in another aspect the present invention may provide a method of installing a subsea well assembly, the method comprising: providing a first subsea well assembly component and a second subsea well assembly component; connecting the first subsea well assembly component and the second subsea well assembly component such that there is a well conduit that extends through both the first subsea well assembly component and the second subsea well assembly component; and connecting first subsea well assembly component and the second subsea well assembly component by one or more load transmitting connectors such that forces can be transmitted both in tension and compression between the first and second subsea well assembly components, wherein at least one of the one or more load transmitting connectors is arranged so that it can be preloaded in tension and at least one of the one or more load transmitting connectors is arranged so that it can be preloaded in compression.

The first subsea well assembly component may be a wellhead valve and/or well control device (such as a BOP, Christmas tree or capping stack for example) or a well foundation (such as a suction anchor or template for example). The second subsea well assembly component may be a wellhead valve and/or well control device (such as a BOP, Christmas tree or capping stack for example) or a well foundation (such as a suction anchor or template for example).

The well fluid conduit may in part be provided by a subsea wellhead and/or one or more well conduit, e.g. fluid sealing, connectors between the subsea well assembly components.

Thus the present invention may provide a method of installing a subsea wellhead assembly, the method comprising: providing a subsea well foundation, a subsea wellhead, and subsea riser system equipment (e.g. wellhead valve and/or well control device) mounted (e.g. fluid sealingly) to the wellhead; and connecting the subsea riser system equipment to the subsea foundation such that at least some forces can be transmitted both in tension and compression between the subsea riser system equipment to the subsea well foundation (e.g. without going via the wellhead).

The two subsea well assembly components (e.g. subsea riser system equipment, well valves and/or well foundation) may be connected by one or more load transmitting connectors. One or more of these connectors may be a connector according to the first aspect of the invention.

The subsea well assembly of the second aspect may be installed using the method of the third aspect and/or the assembly installed by the third aspect may be the assembly of the second aspect.

The present invention may reduce, or be for reducing, riser induced loads onto a well conduit (e.g. for well fluid and/or drilling equipment). This well conduit may be provided at least in part by a subsea wellhead, conduit connectors and/or drill through conduit or another type of bore through the well valves). This may be regarded as providing well conduit load relief, e.g. wellhead load relief. This may be because at least some forces may be transmitted from the first subsea sea well assembly component to the second subsea wellhead component without going via the well conduit (e.g. the components that form the conduit for drilling and/or a sealed fluid path for well fluids from the external environment such as sea water), e.g. the wellhead.

Owing to the fact that the force transmitting connection by one or more load transmitting connectors can transmit forces in both tension and compression, the well conduit load relief can be provided irrespective of whether the subsea riser and/or well assembly moves (or has force acting) towards the point of connection or away from the point of connection.

The force transmitting connection by one or more load transmitting connectors may be preloaded in tension and compression.

By preloading an assembly, comprising several parts, such at least one connection is preloaded in tension, and at least connection is preloaded in compression, the assembly may become more rigid and more suitable for load transfer.

The at least one of the one or more load transmitting connectors arranged so that it can be preloaded in tension and the at least one of the one or more load transmitting connectors arranged so that it can be preloaded in compression may be the same connector such that there is at least one connector that is arranged so that it can be preloaded in both tension and compression.

Thus there may be one or more load transmitting connectors between the first and second components that can be preloaded in both tension and compression.

When a plurality of connectors are provided that can transmit force in both compression and tension (either each in tension and compression or some in tension and some in compression), at least one or more connectors may transmit force in compression whilst at least one or more other connectors (e.g. a connector on the opposite side of the well conduit) may transmit force in tension. This is because in an arrangement with a plurality of connectors when loads are exerted on a subsea well assembly component, the component may at least in part move (or have force acting) towards a connector whilst simultaneously it may in part move (or have force acting) away from another connector.

Thus by having a plurality of connectors that can each transmit forces both in compression and tension the force transmission may be distributed more equally when loads are exerted on the subsea well assembly component. As a result, the actual load on each connector may be reduced as more than one, such as all, of the connectors are still acting to transfer force irrespective of the direction of the force acting on the assembly.

The connectors that can transmit forces both in compression and tension may be preloaded in both tension and compression. The preloading in both tension and compression may mean that in load transfer of alternating loads the force transmitting connectors have no mechanical tolerances (i.e. there is no, or limited give) due to the preload.

The one or more connectors may be arranged so that they can be preloaded such that the one or more connectors can transition from transmitting forces in tension to transmitting forces in compression without there being any relative movement between the first subsea well assembly component and the second subsea well assembly component.

The loads exerted on the assembly may be subsea well assembly component forces (such as BOP riser forces and/or marine drilling riser forces). These loads may be cyclic fatigue loads and/or accidental or abnormally high single-loads. In other words, the connection may be arranged to reduce the effects of both cyclic loads and high single loads on the critical well conduit.

The assembly may reduce the loads transferred to the well conduit (e.g. wellhead) from the subsea well assembly component(s) (e.g. BOP, Christmas tree or capping stack) by 25% or more or 50% or more, (e.g. at least 25%, at least 30%, at least 40%, at least 50%, 50% to 60%, at least 60% or at least 75%) compared to a situation without such a force transmitting connection.

The force transmitting connection(s) between the subsea well assembly components may be arranged so that it increases the stiffness of the assembly.

The force transmitting connection(s) may be designed and/or arranged so that it is able to reduce the loads on the well conduit (e.g. wellhead or fluid conduit connectors between components) from the subsea well assembly components (e.g. well valve and/or well control device which may for example be subsea riser system equipment) such that material fatigue failure and/or structural damage of the subsea wellhead assembly due to abnormally high single loads no longer needs to be a concern during a typical lifetime of the subsea wellhead assembly.

With the present invention it may be possible and/or may be ensured that the well conduit, e.g. wellhead and/or conduit connectors, is exposed to only moderate load effects, well within documented capacity of the equipment (e.g. permissible load limit). The reference to the forces on the well conduit is with reference to the walls of structural components forming the conduit.

The assembly and method may be for, or used for, reducing riser system induced load effects on the subsea wellhead. Thus the present invention may be considered to provide an assembly or a method for reducing riser system induced load effects in subsea wellheads.

The connection (i.e. force transmitting connector) between the subsea riser system equipment and the foundation may be for reducing riser system induced load effects on the subsea wellhead.

One or both of the subsea well assembly components may be a well valve and/or a well control device such as subsea riser system equipment which may be referred to as subsea pressure equipment or subsea pressure containing/controlling equipment. This may be equipment that is installed/located on the wellhead during production from the wellhead or on another well assembly component. The subsea pressure equipment may be subsea production equipment. The subsea riser system equipment may be or comprise a wellhead valve and/or a well control device. For example, the wellhead valve may comprise a Christmas tree (which may also be referred to as a subsea tree), a blowout preventer (BOP) and/or a capping stack.

One or more of the subsea well assembly components may extend vertically up from the wellhead away from the sea bed. The wellhead valve, e.g. riser system equipment, may be connected at its other end to a riser, the upper end of which may be connected to a surface facility such as a floating vessel.

When the wellhead valve, e.g. riser system equipment, comprises, or is, a blowout preventer (BOP), the BOP may comprise a lower part (which may be referred to as a lower stack or a lower BOP stack) and an upper part (which may be referred to as a lower marine riser package (LMRP)). The LMRP may be connected to the top of the lower stack by a remote controlled fluid sealing connector (that may form part of the well fluid conduit).

The lower stack may be connected (e.g. fluidly sealingly) on top of the wellhead or on top of a subsea tree (also called Christmas tree). This may be referred to as a well conduit connector. This connection may also be by a remote controlled connector.

The LMRP may be fluidly connected by a flexjoint to the lower end of the marine drilling riser.

For example, during drilling a blowout preventer may be provided directly on the wellhead and during completion a blowout preventer may be provided with a Christmas/subsea tree on the wellhead. Alternatively, the subsea riser system equipment may comprise a subsea tree without a BOP.

When the first subsea well assembly component is a BOP and the second subsea well assembly component is a well foundation, the force transmitting connection between the BOP and the foundation may be between the lower stack and the foundation. The assembly may be arranged so that the LMRP is not connected to the foundation (other than via the fluid connection made with the lower stack). This is so that if required, the LMRP can be released and removed easily and quickly. For example, the LMRP may be released from the lower stack at any time.

One or more of the subsea well assembly components may be a subsea stack. The subsea stack may sit on the wellhead.

The well valve (e.g. BOP or Christmas tree for example) may be at least partially attached and/or structurally locked to the wellhead (e.g. by means of a well conduit connector forming part of the well conduit that extends from the well in the foundation to the well valve).

The subsea well assembly may comprise a third subsea well assembly component. The well conduit (e.g. for well fluids) may also extend through the third well assembly.

The third subsea well assembly component may be connected (e.g. by a well conduit connector) to one of the first or second subsea well assembly components to provide a well conduit therebetween. The third subsea well assembly component may also additionally be connected (e.g. by means of one or more force transmitting connectors) to the subsea well assembly component to which it is connected to form the well conduit. The additional connection (additional to the well conduit connector) may be such that at least some forces can be transmitted both in tension and compression between the two components without going through the well conduit.

For example, the first subsea well assembly component may be a well foundation such as a suction anchor supporting a wellhead that extends through the foundation, the second subsea well assembly component may be a first well valve such as a BOP or capping stack, and the third subsea well assembly component may be a second well valve such as a Christmas tree. The three subsea well components may be connected by conduit connectors such that there is a well conduit that extends through all three components. The first well valve may be connected to the second well valve, such as by means of a BOP connector that forms a fluid sealing connector between the two components, and the second well valve may be fluidly connected to the wellhead supported by the foundation, such as by means of a Christmas tree connector that forms a fluid sealing connector between the Christmas tree and the wellhead located in the well foundation so as to form the well conduit through the three components. The first subsea well assembly component (e.g. BOP) may be additionally connected to the second subsea well assembly (e.g. Christmas tree) by one or more force transmitting connectors and the second subsea well assembly component (e.g. Christmas tree) may be additionally connected to the third subsea well assembly component (e.g. well foundation) by one or more force transmitting connectors.

The components may only be connected by the well conduit and the force transmitting connectors.

Thus in another aspect the present invention may provide a subsea well assembly, the assembly comprising: a first subsea well assembly component; a second subsea well assembly component; and a third subsea well assembly component, wherein the first subsea well assembly component and the second subsea well assembly component are connected to each other by a first well conduit connector to provide a well conduit therebetween; wherein the second subsea well assembly component and the third subsea well assembly component are connected to each other by a second well conduit connector to provide a well conduit therebetween; wherein the first subsea well assembly component and the second subsea well assembly component are additionally connected (e.g. by one or more force transmitting connectors) such that at least some forces can be transmitted between the first and second components without going through the first conduit connector; and wherein the second subsea well assembly component and the third subsea well assembly component are additionally connected (e.g. by one or more force transmitting connectors) such that at least some forces can be transmitted between the second and third components without going through the second well conduit connector.

The force transmitting connection between the first and second components and/or the second and third components may be such that forces can be transmitted between the components both in tension and compression.

At least one of the one or more load transmitting connectors (between the first and second and/or second and third components) may be arranged so that it can be preloaded in tension and at least one of the one or more load transmitting connectors may be arranged so that it can be preloaded in compression.

The at least one of the one or more load transmitting connectors (between the first and second and/or second and third components) arranged so that it can be preloaded in tension and the at least one of the one or more load transmitting connectors (between the first and second and/or second and third components) arranged so that it can be preloaded in compression may be the same connector such that there is at least one connector that is arranged so that it can be preloaded in both tension and compression.

The one or more connectors (between the first and second and/or second and third components) may be arranged so that they can be preloaded such that the one or more connectors can transition from transmitting forces in tension to transmitting forces in compression without there being any relative movement between the first subsea well assembly component and the second subsea well assembly component.

The foundation may be any known subsea well foundation such as a template or a suction anchor or any other means that provides lateral support to a wellhead/high pressure wellhead housing.

The subsea wellhead may be located within and/or surrounded by the subsea well foundation. The subsea well foundation may laterally support the wellhead.

The present invention may provide a subsea well assembly comprising a wellhead (e.g. a high pressure wellhead housing) and well valve and/or well control device, wherein the well valve is connected (e.g. fluidly) to the wellhead (to form e.g. a well conduit) and force transmittingly connected to the well foundation so that at least some of the loads can be at least partially transmitted from the well valve (e.g. BOP, Christmas tree capping stack) to the foundation without going via (i.e. without passing through or being transferred via) the wellhead.

The present invention may provide a subsea well assembly comprising a first well valve (e.g. BOP) and second well valve (e.g. a Christmas tree), wherein the well valves are connected (e.g. fluidly) to each other (e.g. to form a well conduit therethrough) and force transmittingly connected to each other so that at least some of the loads can be at least partially transmitted between the well valves (e.g. BOP, Christmas tree capping stack) without going via (i.e. without passing through or being transferred via) the fluid connection between the two valves.

The loads which are exerted on one or more subsea well assembly components (e.g. well valves or subsea riser system equipment) may be transferred to both the well conduit (e.g. for well fluids (including the wellhead)) and the foundation. However, the magnitude of the loads being transferred into the well conduit may be reduced compared to an assembly without the force transmitting connection between two well assembly components. This may reduce the risk of damage to the well conduit, e.g. wellhead.

The force transmitting connection between the two subsea well assembly components (e.g. subsea riser system equipment and the foundation) may be by a connector that is directly attached between (e.g. the bottom of) the two components.

For example, one end of a force transmitting connector may be connected (directly or indirectly) to the first component and the other, opposite end of the connector may be connected (directly or indirectly) to the second component.

The force transmitting connector(s) may be directly connected to the components or the connector(s) may be indirectly connected to the components such as via one or more connection parts such as a bracket or clamp which is attached directly to the one or more of the components. In any event, even if not directly connected to one or more of the components, the one or more force transmitting connectors may each extend directly between the two subsea well assembly components and permit forces to be transmitted between the components.

The connector may be attached to a part attached to or part of (e.g. welded to) the first component (e.g. a suction anchor) and may be attached to a part (e.g. a bottom plate or frame) attached to the second component.

Forces (i.e. at least some forces) may be transmitted, via the force transmitting connector(s) between the two subsea well assembly components, from the first component to the second component without going via the well conduit, e.g. wellhead.

The forces may be transmitted between the subsea well assembly components during drilling, completion, and/or workover modes of operation of the wellhead assembly.

The force transmitting connection(s) between the two components may be outside (e.g. radially outwardly) of the well conduit, e.g. wellhead and well conduit connectors. This may for example be a distance of at least 1 meter, at least 2 meters etc. from the well conduit and well conduit connector.

The connection(s) (i.e. force transmitting connections) may be connected at or near the outer edges (i.e. perimeter) of one or more of the subsea well assembly components. This is to maximise the distance between the centre of the assembly (where the well conduit may be located) and the connection that transmits the forces between the first and second subsea assembly components.

The two subsea well assembly components (e.g. subsea riser system equipment and the foundation or another well valve) may be rigidly connected. This may allow force to be effectively transmitted between the components. Each force transmitting connector may provide a force transmission path between the two components it is connected between.

The subsea wellhead assembly may comprise a connector (e.g. a connection device) which allows the two components to be connected (e.g. for subsea riser system equipment or well valve (such as a BOP) to be connected to the foundation).

The assembly may comprise both a well conduit connector and a force transmitting connector. These may be provided by distinct components. These may provide the only connection, i.e. only force transmitting connections between the components. The force transmitting connector may be radially outward of the well conduit connector.

The first subsea well assembly component may be connected to the second subsea well assembly component by a connection device (e.g. a load transmitting connector). Such a connection device may allow forces to be transmitted between the components (e.g. from the subsea riser equipment or wellhead valve to the foundation). The connection device(s) may allow forces to be transmitted between the components both in compression and tension.

This may be achieved by each connection device allowing forces to be transmitted between the components both in compression and tension and/or there being a plurality of connection devices in which at least one or more allows forces to be transmitted between the components in compression and in which at least one or more allows forces to be transmitted between the components in tension.

The assembly may comprise one or more (such as four, six, eight, twelve or more etc.) connectors, i.e. force transmitting connectors.

When there is a plurality of force transmitting connectors, these may located about the well conduit, e.g. the wellhead. The force transmitting connectors may be positioned approximately equidistant around the well conduit. For example, in the case of three connectors they may be located at about 120 degrees apart around the well fluid conduit, or in the case of four connectors they may be located at about 90 degrees apart around the well conduit. This is so that force can be transmitted evenly between the components and (if one of the components is the well foundation, evenly into the foundation).

The force transmitting connector(s) (which e.g. connect the well valve to the foundation) may participate in the transfer of large tension and compression forces between the components.

The force transmitting connector(s) may each extend parallel (or substantially parallel) to the axis of the well fluid conduit/wellhead, i.e. in a substantially vertical direction.

Additionally or alternatively, the force transmitting connector(s) may each extend at an angle (i.e. non-parallel) to the axis of the well conduit/wellhead. This may allow the force transmitting connector(s) to also at least partially transmit horizontal shear loads.

The force transmitting connector(s) may each be a longitudinally extending member, i.e. elongate member, which attaches at one end to a part of one subsea assembly component and at the other end to another subsea assembly component (this may be at connection points on the connector).

The connection (i.e. one or more connectors) between the two components may be preloaded in both tension and compression.

By preloaded it may be meant that there is an internal application of stress. The preload may be a load applied to the connector during installation, before it is subject to any external loads.

The force transmitting connection (e.g. using a load transmitting connector) between the two components may pull the two components together in an axial direction and/or may push the two components apart in an axial direction at the same time. If the preload in tension and compression is equal there may be no additional force (in either tension or compression) between the two components caused by the connector(s), i.e. there may be no net force exerted by the force transmitting connector(s).

The connector may be made up of a number of parts such as a number of connected lines or other components. The connectors may each comprise a connection point at each end and a connection part (e.g. structural element, beam or link) therebetween. When the connector is otherwise unconstrained (e.g. not connected to subsea well assembly components and/or not preloaded), each connection point may be able to move, e.g. pivot and/or rotate, relative to the connection part to which it is connected. The rotation of each connection point may be about the long axis of the connector and/or about an axis that is at an angle (such as perpendicular) to the long axis.

The connector when not connected to the subsea well assembly components and/or not preloaded may be flexible, i.e. the connection points may be able to move relative to each other. This may be achieved by the connection point being connected to the connection part by a link, e.g. a hinge and/or pivot. This may facilitate installation of the device. This is because the connector may be easily manipulated to connect it at one end to a first component and at the other end to a second component. This means that it may still be possible to connect the subsea well assembly components even if there is positional and/or angular misalignment between the components. In other words, the flexibility in the force transmitting connector means that there is less of a stringent requirement on the aligning of the two components.

Each connector may comprise a part (e.g. a tension part) that in use may be in tension and a part (e.g. a compression part) that in use may be in compression. These two parts may be in tension and compression concurrently.

For example, the connector may comprise a line which is in tension. The line, for example, could be a wire, rope, cable, tether, chain or bar etc. The line may be formed from a plurality of steel wire parts which are connected together to form a line.

The connector may also comprise a member that in use may be in compression. The member that is in compression may be a bar, rod or sleeve for example. This may be a member which has an adjustable length such as a telescopic member.

The tension part that in use may be in tension may have an adjustable length and/or the compression part that in use may be in compression may have an adjustable length.

One, more or each connector may comprise a line that can be put into tension that is surrounded by a telescopic sleeve that can be put into compression.

The part that in use can be in tension may be coaxial and/or located within the part that in use can be in compression.

The connector(s) may be (at least when preloaded) axially rigid and may transfer both tensile and compressive loads.

The connectors may comprise one or more actuators that can be used to put the connector (e.g. part of the connector) into tension and/or to put the connector (e.g. part of the connector) into compression.

The connectors may comprise or be connected to tensioners (to put the connector into tension) and/or jacks (to put the connector into compression). The connectors may be arranged such that they can be preloaded in both compression and tension concurrently. This may be in the axial or at least substantially axial direction.

The preload in both tension and compression may be achieved by having one part that can be made shorter and/or one part that can be made longer. This may be achieved using an actuator (e.g. turnbuckle and/or screw-jack) that is part of the connector itself or by means of an external actuator that is used to cause the tension and/or compression before being removed during installation. The connector may comprise a locking device to hold the compression and/or tension preload. This may particularly be the case when the actuator/preload device is an external device that is removed after the compression and/or tension is applied.

One, more or each connector may comprise a tensioner to put part of the connector into tension and may comprise a compression means (e.g. some form of actuator for putting a part into compression, such as a jack) to put part of the connector into compression.

The tension and/or compression may for example be done by the turning of a screw and/or nut. This may adjust the length of a part (e.g. shorten or lengthen a part) such that tension or compression is caused within the component when it is constrained. The actuation may be done by a motor. This may be operated by an ROV and/or hydraulically or electrically activated (e.g. remotely). The force may be provided by a direct acting hydraulic piston for example or some means to apply hydraulic pressure.

A tensioner may be used to put part (e.g. a tension part) of the connector into tension and a jack may be used to put part (e.g. a compression part) of the connector into compression.

One or more of the connectors may have a length which is adjustable. For example, the part that in use is to be in compression may be a telescopic device that can be screwed to make it longer and/or the part that in use is to be in tension may be a telescopic device that can be screwed to make it shorter.

A single actuator (which may be part of the connector itself or a separate external part) may be used to cause the tension and compression in a connector or a plurality of connectors.

Each connector may connect onto the first subsea well assembly component (or a component such an eyelet/padeye attached to the component).

The force transmitting connector(s) may each provide, or may be arranged so as to be able to provide, a rigid connection between the two components.

The force transmitting connection between the two components may, at least in part, be in compression (in an at least substantially axial direction). In this case, the connection between the two components (e.g. well valve and foundation) may comprise a (i.e. at least one) actuator for increasing the length of part of the connector, e.g. a jack. When the force transmitting connection between the components is in compression, the well conduit connection between the components may be in tension.

The connection between the components may also, at least in part, be in tension. In this case, the connection between the components may comprise a (i.e. at least one) tensioner (e.g. turnbuckle). When the force transmitting connection between the components is in tension the well conduit connection between the components may be in compression.

The connection (such as one or more, or each of the connectors) may be provided with or comprise a preload device for allowing a preload to be exerted on the connector.

The preload device may be integral with a respective connector. Alternatively the preload device, e.g. the tensioner or jack, may be separate from the connectors. In either case the preload device(s) may act to preload the connector (s).

The preload device may be used to remove slack/play in the connection device. This may ensure that forces can be transmitted most effectively from the subsea riser system equipment to the foundation via the force transmitting connection device.

When the force transmitting connector(s) are preloaded in both tension and compression (either each connector being preloaded in both tension and compression or having one or more preloaded in tension and one or more preloaded in compression), load transfer of alternating loads can be effectively tolerated. This is because the preload means that there is no slack/play/give in the connection that would allow the connected assemblies to move relative to each other, e.g. cyclic movements.

The preload device(s) may each be arranged to provide a preload in the range of 100-1000 kN, such as 500 to 1000 kN.

For example, the preload device may be a tensioner for putting the connector (and hence the force transmitting connection between the components) into tension.

The connector(s) may each be provided with a tensioner, i.e. a device that can act to cause a tension on at least part of the connector to which it is attached. The tensioner may be used to put the connector into tension so as to be able to transmit forces between the components. The tensioner may be used to provide a pretension on the connector(s). This is so that the connector(s) can be used to reduce (compared to an assembly without connector(s)) the load which is transmitted to the well conduit from the assembly, e.g. from riser system equipment.

The tensioner may be of a linear type, such as a chain jack, a chain hoist, or a screw jack tensioner (this may also be referred to as a mechanical rope tensioner).

The preload device may be a device, such as a jack, for putting at least part of the connector (and hence the force transmitting connection between the subsea riser system equipment and the foundation) into compression.

Each preload device, e.g. tensioner(s) or jack(s), may be operable using an ROV.

The ROV operated tensioners may lock to a component, such as a well valve by hooks (or some other means) and act to pull the component downwards.

Each preload device may be arranged so that it can be remotely controlled.

Each preload device may be arranged so that it can be remotely released.

The preload device may be remotely operated without a ROV. For example, certain components of the assembly, e.g. a Christmas tree and a BOP, may have hydraulic power and controls to the surface. These may run alongside the riser during operations. In these cases for example, the preload device (e.g. jack and/or tensioner) may be controlled from surface. This may be without the use of an ROV.

The assembly may comprise a measurement device for measuring the magnitude of tension and/or compression in the connectors, e.g. the force transmitting connectors. This may be used to ensure that an appropriate amount of tension and/or compression is applied (both during and after the installation and after a period of time, such as weeks, months and/or years of operation). This may also be used as feedback that is used when controlling/applying the preload.

Each preload device may be arranged so that it can be mechanically released by a ROV.

Each preload device may be controlled and/or powered by use of a mechanical, hydraulic or electric method.

Each preload device may be arranged so that it can be set up and operated using a remotely operated vehicle (ROV), e.g. a ROV manipulator. This means that the assembly may be installed and set up subsea and at any water depth without difficulty.

Each preload device may comprise a ROV torque bucket. This is so that each preload device can be operated using an ROV operated torque tool.

The invention may provide a method of connecting two subsea well assembly components using a connector. The connector may be a connector of the first aspect of the invention.

The method may comprise connecting the connector at one end to a first subsea well assembly component and connecting the connector at the other end to a second subsea well assembly component.

The method may comprise preloading at least part (e.g. a tension part) of the connector in tension.

The method may additionally comprise preloading at least part (e.g a compression part) of the connector in compression.

The method may comprise adjusting the length of part of the connector to preload at least the compression part of the connector in compression and/or adjusting the length of part of the connector to preload at least the tension part of the connector in tension.

The steps of the method, and in particular the steps of applying tension and compression, can be carried out in any order, for example, the step of applying tension and compression can be carried out in either order or applied concurrently. For example, the tension part of the connection may be put in tension and then the compression part of the connection may be put in compression, or part of the connection may be put in compression and then part of the connection may be put in tension, or the tension and compression may be applied substantially concurrently.

The preload in tension and the preload in compression may be applied independently. For example, rather than the pre-tension causing an equal and opposite pre-compression (or vice versa), in the present case there may be a two-step process of applying a preload in tension and separately applying a preload in compression. This two-step process may be sequential and/or concurrent.

The method may comprise adjusting the length of part of the connector, such as by telescopic movement of parts, to provide the tension and/or compressive preload.

The preload in tension may be equal to the preload in compression. This may mean that in the absence of any external forces the connector may not apply any net force between the two subsea well assembly components.

The preload in tension may be unequal to the preload in compression. This may mean that in the absence of any external forces the connector may apply a net force between the two subsea well assembly components.

The method of installing the subsea wellhead assembly may comprise connecting the first subsea well assembly component (e.g. a well foundation supporting a wellhead) to the second subsea well assembly component (e.g. a well valve) to form the well conduit. The method may also comprise connecting a third subsea assembly component (e.g. a second well valve) to the second subsea well assembly component to form the well conduit. These two well conduit connectors may for example be fluid sealing connections.

The method may comprise using one or more load transmitting connectors to provide an additional (force transmitting) connection between the first and second components and the second and third components (if the third component is present).

Each force transmitting connector may comprise a preload device, for causing a preload in tension and/or compression, such as a tensioner and a jack, and the method may comprise preloading one or more connectors between the two components. This may comprise preloading the connectors in both tension and compression (either by one or more or each connector being in both tension and compression or by some connectors being preloaded in tension and some being preloaded in compression) such that force can be transmitted both in compression and tension between the two components between which the force transmitting connectors are connected.

The operation of the preload device may put the connection device into compression and tension and may put the well conduit connection between the two components into tension, compression or neutral depending at least in part on the net preload force on the one or more force transmitting connectors between the two components.

In the case of the preload device being an actuator that exerts a compressive force, e.g. a jack, the well conduit connection may be put into tension if the preload exerted by the actuator(s) on the upper component is greater than the weight (i.e. submerged weight) of the equipment above the actuator(s).

Connecting the components (e.g. subsea riser system equipment to the foundation) such that forces can be transmitted may occur after, before or while the components are connected (e.g. after the subsea riser system equipment is connected to the wellhead) to form the well conduit.

The steps of the method may be performed in any order.

The method of installing each force transmitting connector may comprise one or more of the steps of connecting the connector at each end to one of the components (this may be done before or after (or a combination of before and after) the components are deployed subsea), tensioning the connector (e.g. using a tensioner), aligning the connector, applying an internal compression to the connector (which may be before, after or while the tension is being applied), resulting in a connector that is preloaded both in tension and compression and final locking of the connector.

One or more or each connector may be connected at least at one end to one of the components before it is deployed subsea.

In the case for example that the first component is a well foundation and the second component is subsea riser system equipment (such as a BOP), the riser system equipment may be connected to the wellhead supported by the foundation, and then once connected to the wellhead, the subsea riser system equipment may be connected to the foundation by the one or more force transmitting connectors. The present invention may provide a method of installing a subsea wellhead assembly with any, one or more of the above described features, including optional features.

The method may comprise connecting two subsea well assembly components by means of one or more force transmitting connectors, deploying and installing the components subsea (i.e. connected together), and once in position subsea (e.g. once the foundation is installed on the sea bed), connecting the well conduit by means of one or more well conduit connectors.

The subsea well assembly components (which may for example comprise one or more of a well foundation, a well valve, such as a Christmas tree, BOP or Capping stack) may be deployed subsea connected together (wherein the components are connected either by the force transmitting connector(s), the well conduit connectors, or both) such that they are installed in a single deployment operation. Thus for example a well foundation, Christmas tree and/or BOP may be installed together in a single deployment operation.

The connection via the force transmitting connectors may help to relieve and/or avoid loads on the well conduit during installation. This may either be due to the well conduit connectors not being connected during deployment (as the assembly may be held together by the force transmitting connectors) or being connected but force being transmitted at least in part through the force transmitting connector(s) rather than through the well conduit connector(s).

A method of uninstalling a subsea well assembly comprising a first subsea well assembly component and a second subsea well assembly component may be provided. The method may comprise disconnecting the first subsea well assembly component and the second subsea well assembly component to disengage a well conduit that extends through both the first subsea well assembly component and the second subsea well assembly component; and additionally disconnecting first subsea well assembly component and the second subsea well assembly component such that forces can no longer be transmitted between the first and second subsea well assembly components.

These disconnection steps may occur in any order. These disconnection steps may occur subsea or the components may be retrieved from the seabed in one part whilst at least partially still connected and then disconnected at or near the surface.

One or more of the features, including the optional or preferable features, of any of the above described aspects are applicable to any of the other above described aspects of the invention.

Certain preferred embodiments of the present invention will now be described by way of example only with reference to the accompanying drawings, in which.

Figure 1:
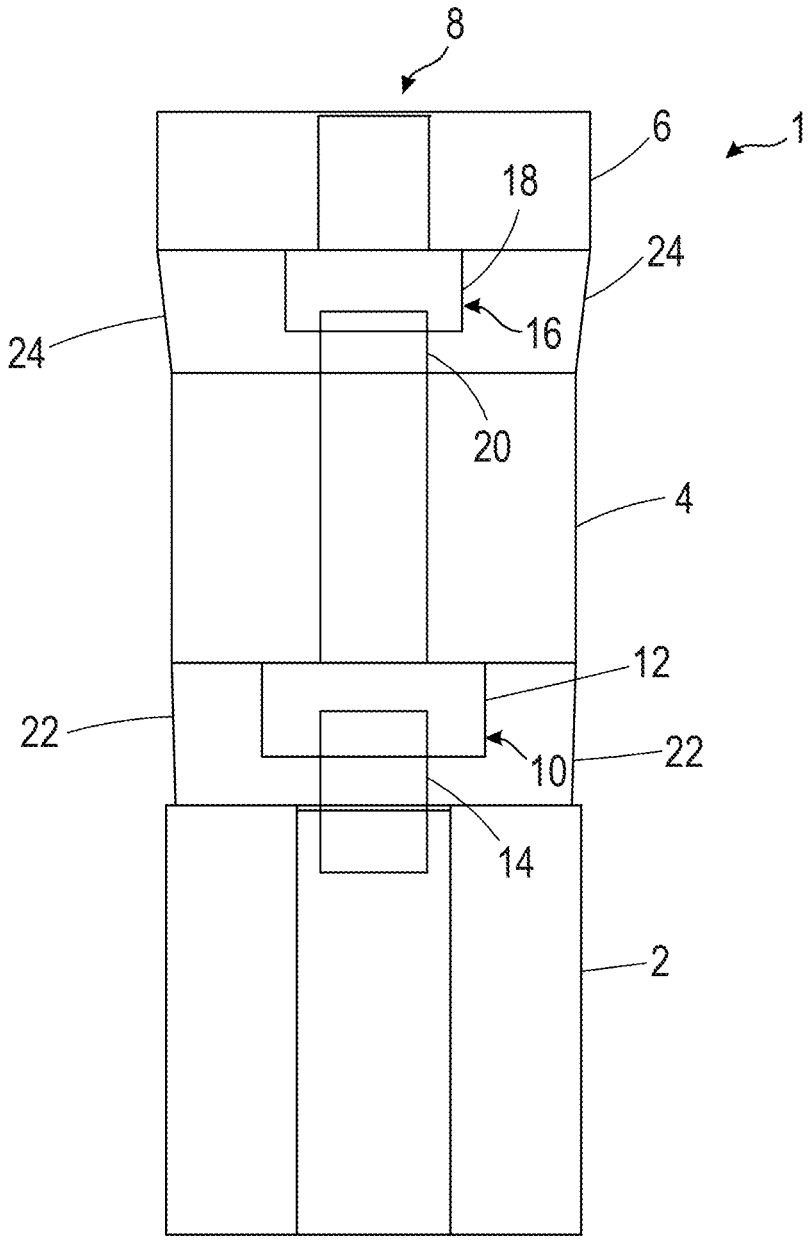
FIG. 1 is a schematic of a subsea well assembly.

FIG. 1 shows a schematic of a subsea well assembly 1. The assembly comprises a first subsea well assembly component 2, a second subsea well assembly component 4 and a third subsea well assembly component 6. The first component 2 may for example be a subsea well foundation such as a suction anchor. The second component 4 may be a first well valve and/or well control device such as a Christmas tree for example. The third component 6 may be a second well valve and/or well control device such as a blow out preventer (BOP) for example.

Running through the components is a well conduit 8. The well conduit 8 runs from the bottom of the assembly 1 through the components 2, 4, 6 to the top of the assembly. The well conduit 8 may be used for conveying well fluids and/or for drilling equipment to extend therethrough (depending for example on the mode of operation of the well). The first and second subsea well assembly components 2 and 4 are connected by a first well conduit connection 10. This connection may be between a Christmas tree connector 12 on the bottom of the Christmas tree 4 and a wellhead 14 supported by the foundation 2. The second and third subsea well assembly components 4 and 6 are connected by a second well conduit connector 16. This connection may be between a BOP connector 18 on the bottom of the BOP 6 and a Christmas tree re-entry hub 20 extending from the top of the Christmas tree 4.

The first and second components 2, 4 are also connected by force transmitting connectors 22. These connectors 22 together and optionally each can transmit force between the first and second components 2, 4 both in tension and compression.

The second and third components 4, 6 are also connected by force transmitting connectors 24. These connectors 24 together and optionally each can transmit force between the second and third components 4, 6 both in tension and compression. The connectors 22 and/or 24 may be preloaded in tension and compression such that they can transition from transmitting forces in tension to transmitting forces in compression (and vice versa) without there being any relative movement between the well assembly components.

The force transmitting connectors 22, 24 may be the connectors that are described below in more detail in connection with FIGS. 2 to 5. Two or all three of the components 2, 4, 6, may be connected together (either by the conduit connectors 10, 16 or the load transmitting connectors 22, 24 or both) at the surface and then deployed subsea at least partially connected together in a single deployment operation during installation. Alternatively, the components 2, 4, 6 may be deployed subsea separately and connected by means of conduit connectors 10, 16 and/or load transmitting connectors 22, 24 when the components 2, 4 and 6 are subsea.

When connected, the load transmitting connectors 22, 24 may be used to transmit at least some forces between the components, 2, 4, 6 such that less force is transmitted between the components through the well conduit 8 and the well conduit connectors 10, 16.

As shown, the load transmitting connectors 22, 24 may be located radially outwardly of the well conduit connectors 10, 16. The load transmitting connectors 22, 24 may be connected to the components at or towards their outer surfaces so as to maximise the distance between the well conduit 8 and the force transmitting connectors 22, 24.

The only connections between the components 2, 4, 6 may be provided by the well conduit 8 (via the conduit connectors 10, 16) and the force transmitting connectors 22, 24.

Figure 2:
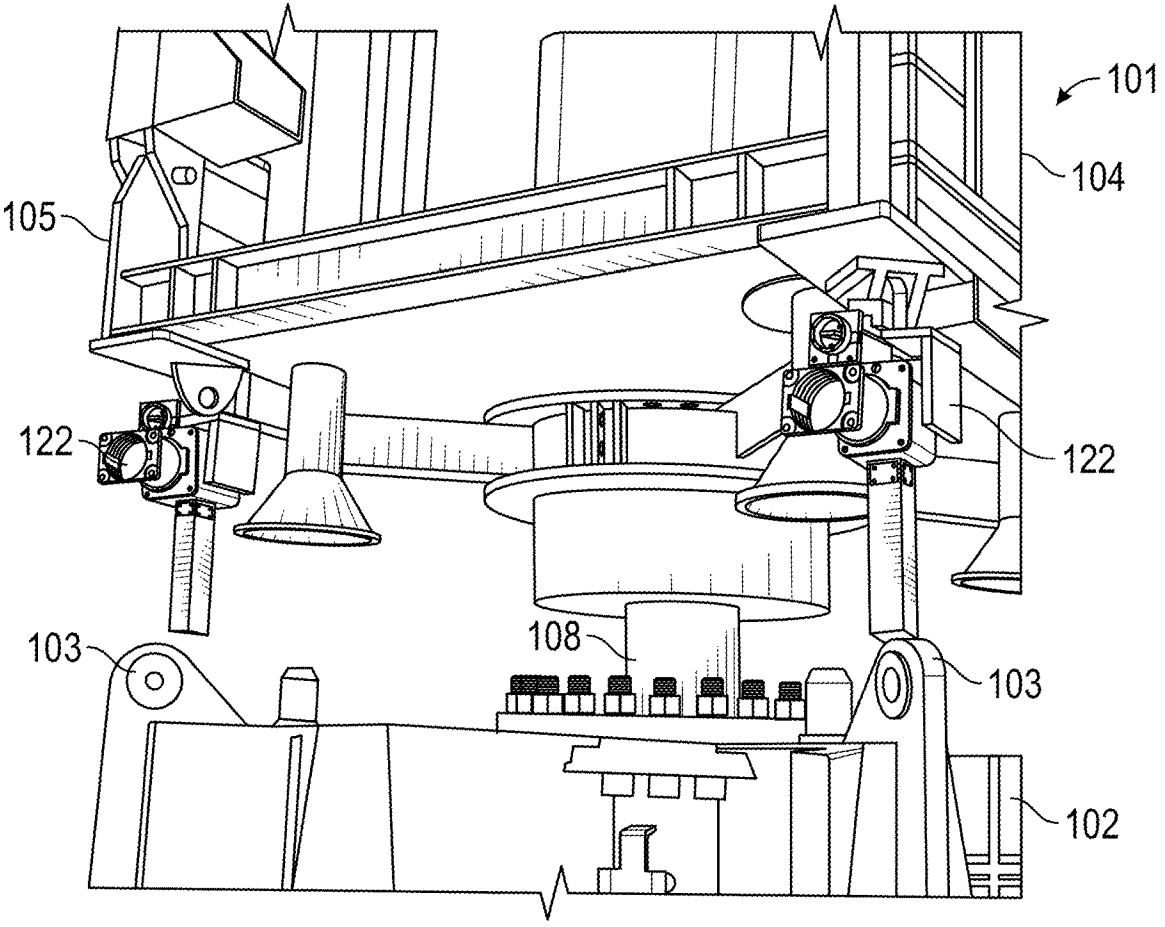
FIG. 2 shows part of an assembly with force transmitting connectors during installation.

FIG. 2 shows an assembly 101 with a well foundation 102 and a well valve 104 which may be a BOP for example. Extending between the well valve 104 and the well foundation 102 is a well conduit 108 through which well fluids and drilling equipment can pass.

The well valve 104 has a plurality of load transmitting connectors 122 connected to it. The load transmitting connectors 122 are each connected at one end to a frame 105 mounted on the wellhead valve 104. The other end of the load transmitting connectors 122 can be connected (FIG. 2 shows the arrangement before the connectors 122 are connected to the foundation 122) to the connection eyes 103 on the well foundation 102 to permit at least some forces to be transferred from the wellhead valve 104 to the foundation 102 without going via the well conduit 108.

Figure 3:
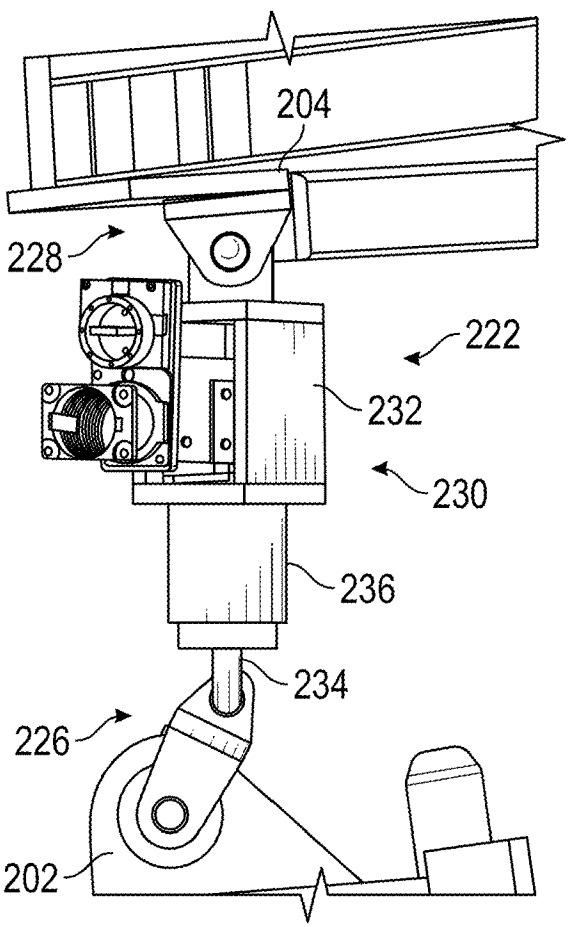
FIGS. 3, 4 and 5 show stages of installing a force transmitting connector.
Figure 4:
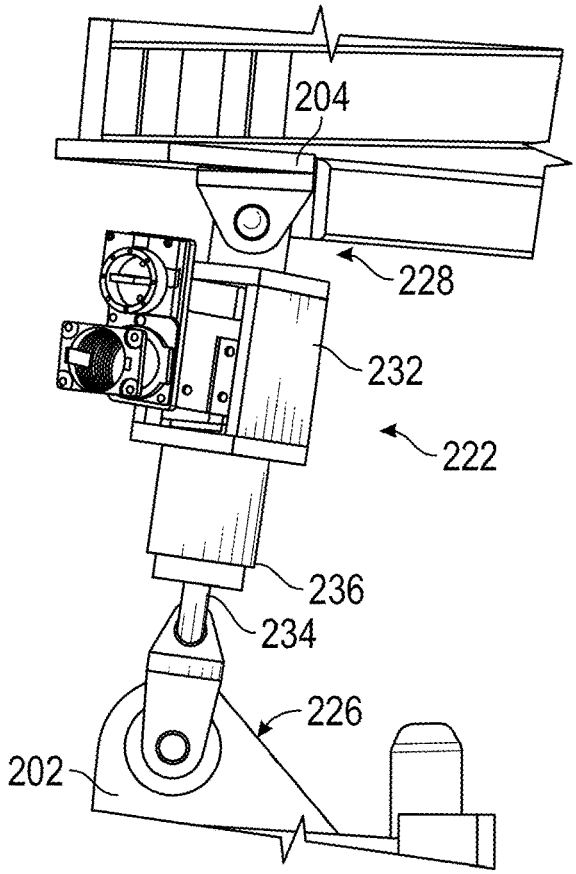
Figure 5:
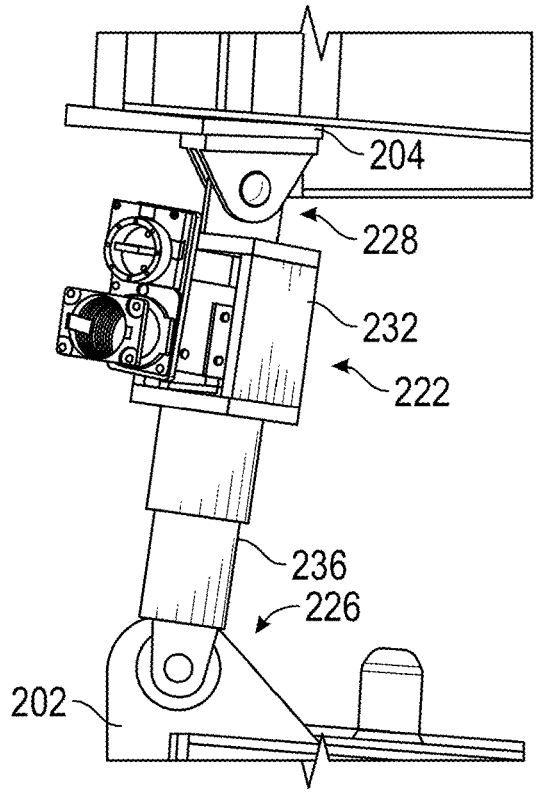

FIGS. 3, 4 and 5 show an exemplary load transmitting connector 222 that permits a force transmitting connection to be made between a first subsea well assembly component 202 and a second subsea well assembly component 204.

The load transmitting connector 222 comprises a first connection point 226 for connection to the first component 202 and a second connection point 228 for connection to the second component 204 with a connection portion 230 therebetween.

The connector 222 comprises an actuator 232. This actuator may be used to put a portion 234 of the connector 222 in tension and a portion 236 in compression.

The connection between the connector 222 and second component 204 by means of the connection point 228 may be a pivotable connection.

The connection between the first connection point 226 and the connection potion 230 may be a flexible link connection. This may allow the connection point 226 to move, e.g. pivot and rotate (about at least two axes), relative to the connection portion 230 of the connector 222.

The connector 222 may be connected to the second component 204 either after the second subsea well assembly component 204 have been deployed subsea or the connection may be made at the surface before the component 204 is deployed.

The connection at the other end to the first component 202 may similarly be made at the surface or after the component 202 has been deployed subsea.

The connector 222 may be first connected to the second component 204 via connection point 228 and then connected to the first component 202 by the first connection point 226. The flexibility in the link connection at connection point 226 may facilitate the connecting of the connector 222 between the two components 202 and 204.

Once connected at each end as shown in FIG. 3, part 234 of the connector 222 may then be put into tension as shown in FIG. 4. This may be achieved using a tensioner in the actuator 232. This may shorten the central part 234 so as to put it into tension to provide a preload force between the two components.

The telescopic sleeve 236 may then be lengthened and forced into compression as shown in FIG. 5. This may result in the connector 222 having a part 234 preloaded in tension and a part 236 preloaded in compression.

The invention claimed is:

1. A load transmitting connector for connecting two subsea well assembly components fluidly connected by a conduit, the load transmitting connector comprising:

a tension part, a compression part, a first connection point, and a second connection point, wherein the first connection point is arranged to be connected to one of the subsea well assembly components and the second connection point is arranged to be connected to the other of the subsea well assembly components, wherein the connector is arranged such that the connector can be preloaded in both tension and compression concurrently, wherein the tension part is arranged such that the tension part can be preloaded in tension and the compression part is arranged such that the compression part can be preloaded in compression, wherein the tension part has an adjustable length and/or the compression part has an adjustable length, and the load transmitting connector is arranged so that force transmitted through the connector between the two subsea wellhead assembly components is not transmitted through a well conduit.

2. The connector according to claim 1, wherein the connector comprises a connection part extending between the first and second connection points, and wherein, when the connector is otherwise unconstrained, at least one of the connection points is able to move, relative to the connection part to which it is connected.

3. The connector according to claim 1, wherein the tension part that in use is in tension is located within the compression part that in use is in compression.

4. The connector according to claim 3, wherein the compression part is a telescopic sleeve that surrounds the tension part.

5. The connector according to claim 1, wherein the connector comprises one or more actuators to put the tension part of the connector into tension and to put the compression part of the connector into compression.

6. A method of connecting two subsea well assembly components using the load transmitting connector of claim 1, wherein the method comprises:

connecting the connector to a first subsea well assembly component;

connecting the connector to a second subsea well assembly component;

preloading at least the tension part of the connector in tension;

preloading at least the compression part of the connector in compression; and adjusting the length of part of the connector to preload at least the compression part of the connector in compression and/or adjusting the length of part of the connector to preload at least the tension part of the connector in tension.

7. The method according to claim 6, wherein the preload in tension is not equal to the preload in compression.

8. A subsea well assembly, the assembly comprising:

a first subsea well assembly component; and a second subsea well assembly component;

wherein the first subsea well assembly component and the second subsea well assembly component are connected to each other to provide a well conduit therebetween; and wherein the first subsea well assembly component and the second subsea well assembly component are additionally connected by one or more load transmitting connectors such that at least some forces can be transmitted through at least one of the one or more load transmitting connectors both in tension and compression between the two components without those forces going through the well conduit, wherein at least one of the one or more load transmitting connectors can be preloaded in tension and at least one of the one or more load transmitting connectors can be preloaded in compression.

9. The subsea well assembly according to claim 8, wherein the first subsea well assembly component is a wellhead valve or a well foundation and the second well assembly component is a wellhead valve or a well foundation.

10. The subsea well assembly according to claim 8, wherein the at least one of the one or more load transmitting connectors that can be preloaded in tension and the at least one of the one or more load transmitting connectors that can be preloaded in compression are the same connector such that there is at least one load transmitting connector that can be preloaded in both tension and compression.

11. The subsea well assembly according to claim 8, wherein the one or more connectors can be preloaded in both tension and compression such that, in load transfer of alternating loads, the force transmitting connectors have no mechanical tolerances.

12. The subsea well assembly according to claim 8, wherein one or more of the load transmitting connectors is a connector for connecting two subsea well assembly components;

wherein the connector can be preloaded in both tension and compression concurrently, wherein the connector comprises a tension part that can be preloaded in tension and a compression part that can be preloaded in compression, and wherein the tension part has an adjustable length and/or the compression part has an adjustable length.

13. The subsea well assembly according to claim 8, wherein the one or more connectors are each preloaded in both tension and compression.

14. The subsea well assembly according claim 8, wherein the one or more connectors are connected at or near the outer edge of one or more of the subsea well assembly components.

15. A method of installing the subsea well assembly of claim 8, the method comprising:

providing the first subsea well assembly component and the second subsea well assembly component;

connecting the first subsea well assembly component and the second subsea well assembly component such the well conduit extends through both the first subsea well assembly component and the second subsea well assembly component; and connecting first subsea well assembly component and the second subsea well assembly component by the one or more load transmitting connectors such that forces can be transmitted both in tension and compression between the first and second subsea well assembly components through the one or more load transmitting connectors without those forces going through the well conduit, wherein at least one of the one or more load transmitting connectors can be preloaded in tension and at least one of the one or more load transmitting connectors can be preloaded in compression.

16. The method according to claim 15, wherein the at least one of the one or more load transmitting connectors that can be preloaded in tension and the at least one of the one or more load transmitting connectors that can be preloaded in compression are the same connector such that there is at least one connector that can be preloaded in both tension and compression.

17. A method of uninstalling the subsea well assembly of claim 8, the method comprising:

providing the subsea well assembly;

disconnecting the first subsea well assembly component and the second subsea well assembly component to disengage the well conduit; and additionally disconnecting the additional connection by disconnecting the one or more load transmitting connectors.

18. A subsea well assembly, the assembly comprising:

a first subsea well assembly component;

a second subsea well assembly component; and a third subsea well assembly component, wherein the first subsea well assembly component and the second subsea well assembly component are connected to each other by a first well conduit connector to provide a well conduit therebetween;

wherein the second subsea well assembly component and the third subsea well assembly component are connected to each other by a second well conduit connector to provide a well conduit therebetween;

wherein the first subsea well assembly component and the second subsea well assembly component are additionally connected by at least one load transmitting connector such that at least some forces can be transmitted between the first and second components through the at least one load transmitting connector without those forces going through the first well conduit connector; and wherein the second subsea well assembly component and the third subsea well assembly component are additionally connected by at least one load transmitting connector such that at least some forces can be transmitted between the second and third components through the at least one load transmitting connector without those forces going through the second well conduit connector.

19. The subsea well assembly according to claim 18, wherein the subsea well assembly components are connected by one or more load transmitting connectors such that forces can be transmitted between the components both in tension and compression.

20. The subsea well assembly according to claim 18, wherein the first subsea well assembly component is a well foundation supporting a wellhead, the second subsea well assembly component is a first well valve, and the third subsea well assembly component is a second well valve.

* * * * *